United States Patent [19]

Tuson

[11] 4,231,681

[45] Nov. 4, 1980

[54] STRUCTURE FOR SEA-BED EXPLOITATION ALLOWING THE VARIOUS FUNCTIONS INHERENT IN SUCH EXPLOITATION TO BE PERFORMED

[75] Inventor: Samuel Tuson, Mesnil-le-Roi, France

[73] Assignee: Entreprise d'Equipements Mecaniques et Hydrauliques E.M.H., France

[21] Appl. No.: 940,998

[22] Filed: Sep. 11, 1978

[30] Foreign Application Priority Data

Sep. 23, 1977 [FR] France ..... 77 28800

[51] Int. Cl.[2] ..... E21B 43/01; E21B 7/12

[52] U.S. Cl. ..... 405/195; 405/202

[58] Field of Search ..... 405/195–209, 405/169, 170; 175/7, 10; 166/350, 359, 367

[56] References Cited

U.S. PATENT DOCUMENTS

| | | | |
|---|---|---|---|
| 3,375,669 | 4/1968 | Garcia | 405/203 |
| 3,434,295 | 3/1969 | Manning | 405/170 |
| 3,656,307 | 4/1972 | Mott . | |
| 3,708,985 | 1/1973 | Pogonowski et al. . | |
| 3,881,549 | 5/1975 | Thomas | 405/203 X |
| 4,119,145 | 10/1978 | Tuson | 175/10 X |

FOREIGN PATENT DOCUMENTS

| | | |
|---|---|---|
| 1297367 | 5/1962 | France . |
| 1340144 | 9/1963 | France . |
| 2006385 | 12/1969 | France . |
| 1594818 | 6/1970 | France . |
| 2128120 | 10/1972 | France . |
| 2157733 | 6/1973 | France . |
| 7301473 | 8/1974 | Netherlands . |
| 1467800 | 3/1977 | United Kingdom . |

OTHER PUBLICATIONS

Offshore, vol. 29, Nov. 1969, pp. 64–70.

World Oil, vol. 169, pp. 105–109.

*Primary Examiner*—Dennis L. Taylor

*Attorney, Agent, or Firm*—Steinberg and Blake

[57] ABSTRACT

The invention relates to a structure for sea-bed exploitation allowing the various functions inherent in such exploitation to be performed, such as for example production, reconditioning and maintenance of underwater well-heads, wherein said structure comprises at least one articulated column performing one or several said functions. In particular, each well-head is accessible through servicing means, such as a movable tool secured to and jointly movable with a support pivotally connected to a carriage movable along guide-rails mounted either within or outside the horizontal apparent contour of the body of the column.

19 Claims, 32 Drawing Figures

Figure 1:
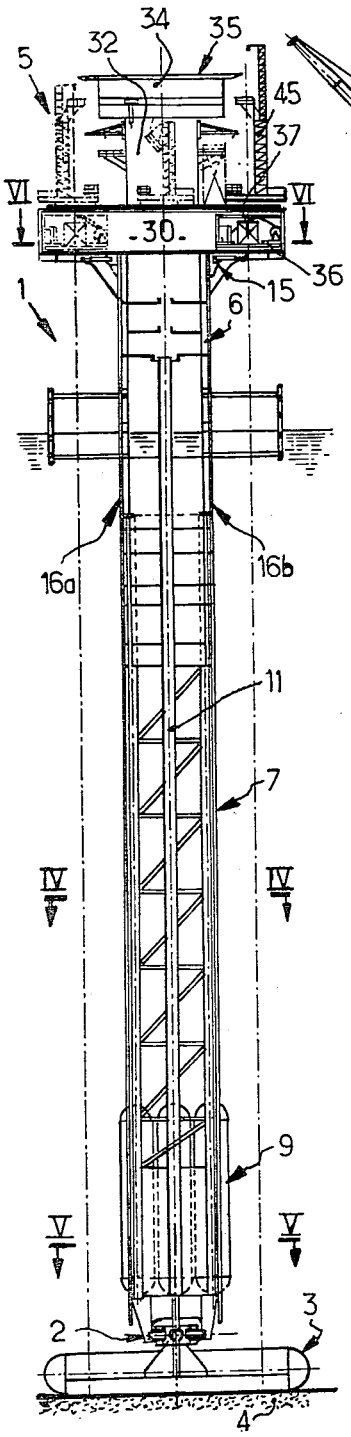

Fig: 10.
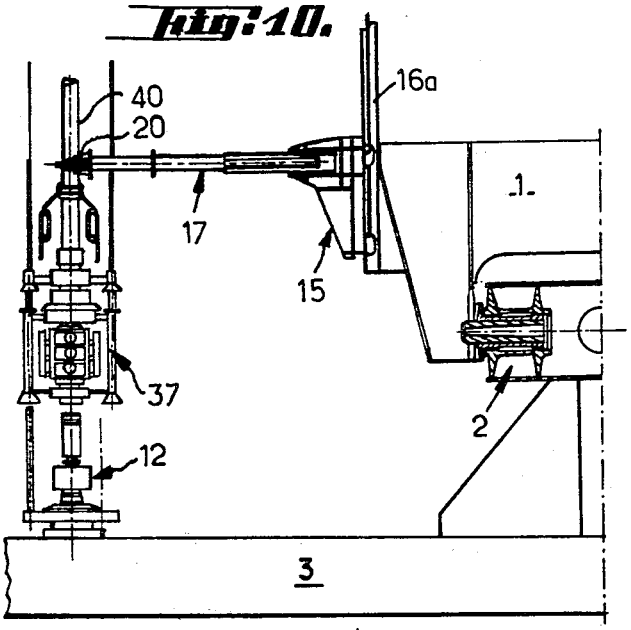
Fig: 9.
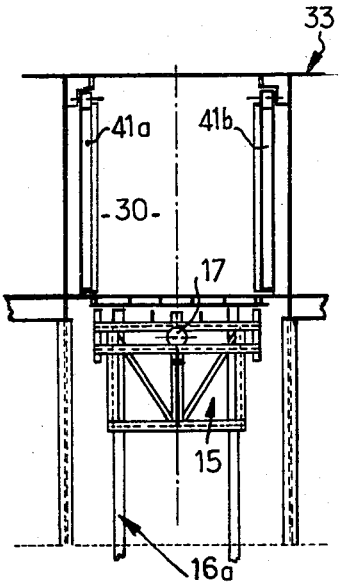
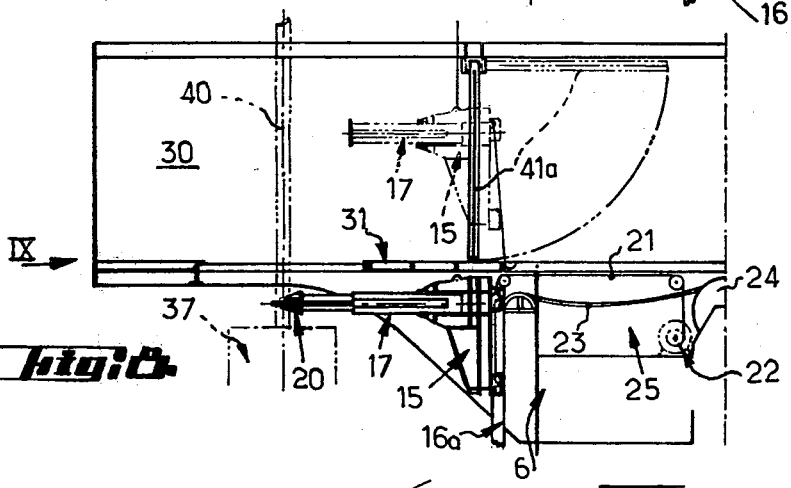
Fig: 8.
Fig: 7.
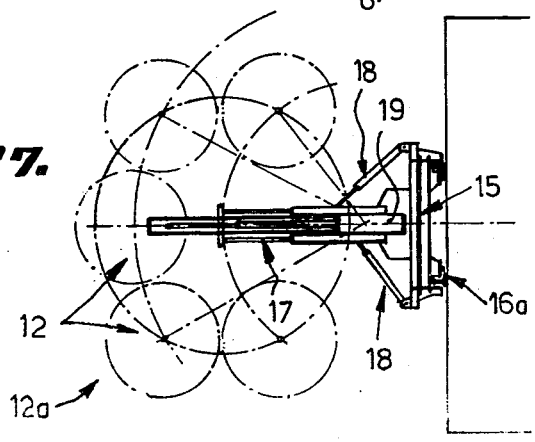

STRUCTURE FOR SEA-BED EXPLOITATION ALLOWING THE VARIOUS FUNCTIONS INHERENT IN SUCH EXPLOITATION TO BE PERFORMED

The present invention relates generally to a structure for sea-bed exploitation, and its object is more particularly to generalize the use of articulated columns to perform the various functions inherent in the exploitation of, in particular, an underwater oil-field.

Nowadays, the use of large platforms is contemplated only for very important oil-fields and maximum water depths of from 100 to 150 meters, and there is a growing tendency towards lighter designs using underwater well-heads.

The competitivity of articulated columns, as regards particularly costs, time-limits, and flexibility of installation and use, allows their use to be contemplated, according to the main purpose of the present invention, for production from and independent exploitation of, in particular, small oil-fields, or marginal oil-fields, or as structures for immediate initiation of production from large oil or gas reserves.

In addition to the operation involved in drilling, placing the well-heads, producing, reinjecting water or gas into the productive layers, oil processing and conveying, there arise all the problems involved in the reconditioning and maintenance of the underwater well-heads, which must be carried out at regular intervals.

In the existing designs use is made of:

Either a fixed platform substantially aligned with an underwater well, with production and safety units located at the emerged top of the platform, this type of structure suffers from drawbacks which result from the fixity of the platform which, in addition, has a heavy and therefore costly structure.

Or a fixed, or semi-submersible, platform with isolated underwater well-heads connected to the surface through production lines, and with remote-control of the production units from the platform. This type of structure has drawbacks, for there is no protection provided for the isolated well-heads, the production lines and the remote-control lines. Moreover, in the case of a semi-submersible platform, there may arise the necessity of interrupting production in case of bad weather.

According to the invention, the use of articulated columns allows, among other things, the said drawbacks to be avoided while at the same time allowing all the operations involved in starting the exploitation of and exploiting an oil-field to be performed and making it possible for definite functions to be concentrated at one and the same articulated column.

To this end, the invention provides a structure for sea-bed exploitation allowing the various functions inherent in such exploitation to be performed, such as production, reconditioning and maintenance of underwater well-heads, water or gas injection into the productive layers of the sea-bed, etc, and is characterized in that it comprises at least one articulated column performing one or several such functions.

According to another characterizing feature of the invention, regarding more particularly the underwater well-head reconditioning and maintenance operations, the well-heads are clustered into at least one group in the base of the column or in immediate proximity to said base, within and/or outside the horizontal apparent contour of the body or casing of the said column.

According to another characterizing feature of the invention, each underwater well-head is accessible vertically by means of an intervention element such as a tool secured to a support pivotally connected to a carriage movable along guiderails extending along and secured to the column.

According to another characterizing feature of the invention, some of the intervention tools, stored in the emerging portion of the articulated column are movable in a substantially horizontal plane so as to be positioned vertically to the centre of each of the well-head groups clustered at the base.

According to another characterizing feature of the invention, the structure for exploiting the sea-bed is equipped with at least one articulated column ensuring in particular the reconditioning and maintenance of underwater well-heads clustered at its base outside the horizontal apparent contour of the Cardan joint.

According to another characterizing feature of the invention, the structure for exploiting the sea-bed is equipped with at least one articulated column ensuring in particular production, reconditioning and maintenance of the well-heads clustered at its base within the horizontal apparent contour of the column, as well as the burning of the gas and/or its conveyance towards a column of the structure for use as a source of energy.

According to another characterizing feature of the invention, the structure for exploiting the sea-bottom is equipped with a least one articulated column ensuring in particular the injection of water or gas into underwater well-heads clustered in its base within the horizontal apparent contour of the column, as well as the reconditioning and maintenance of those well-heads.

According to another characterizing feature of the invention, the structure for exploiting the sea-bed is equipped with at least one articulated column for injecting water and/or gas, associated with one or several isolated well-heads.

According to another characterizing feature of the invention, the structure for exploiting the sea-bed is equipped with at least one articulated column ensuring in particular the operations involved in the production, reconditioning and maintenance of the underwater well-heads outside the horizonal apparent contour of the column, as well as the burning of the gases.

According to another characterizing feature of the invention, the structure for exploiting the sea-bed comprises several aforesaid articulated columns, each performing its own functions ensuring independent exploitation of an underwater oil-field.

Figure 2:
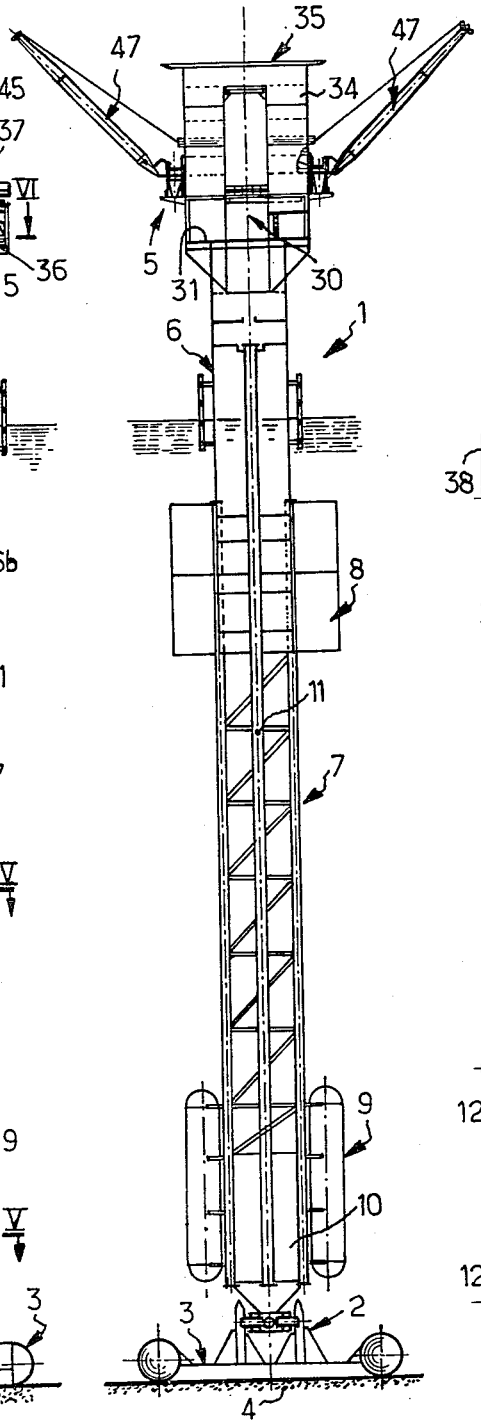
Figure 5:
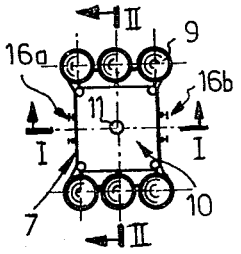
Figure 6:
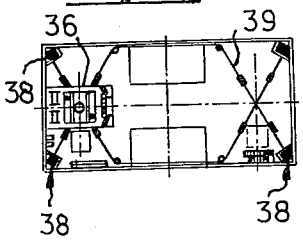
Figure 4:
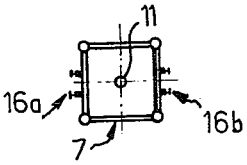
Figure 3:
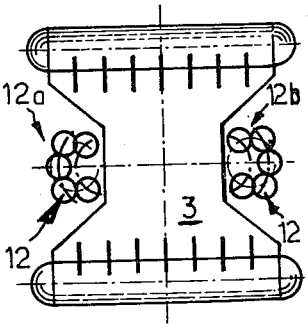
Figure 12:
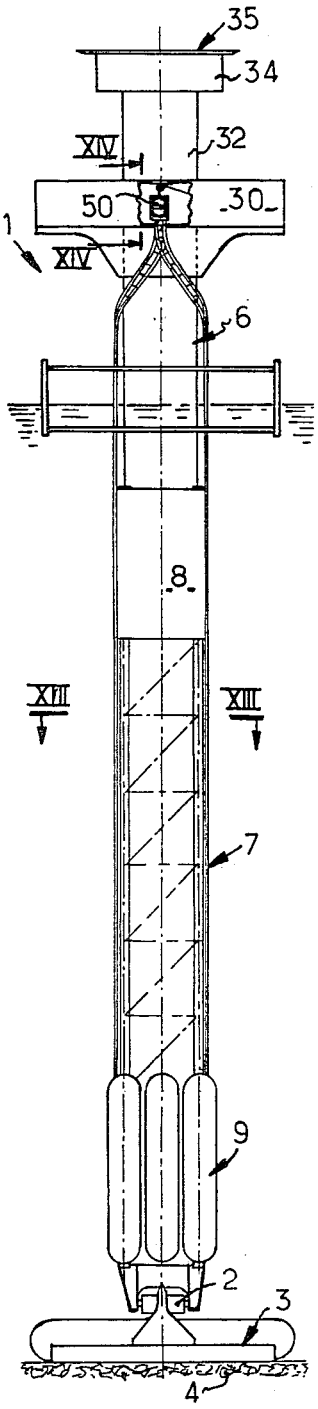
Figure 11:
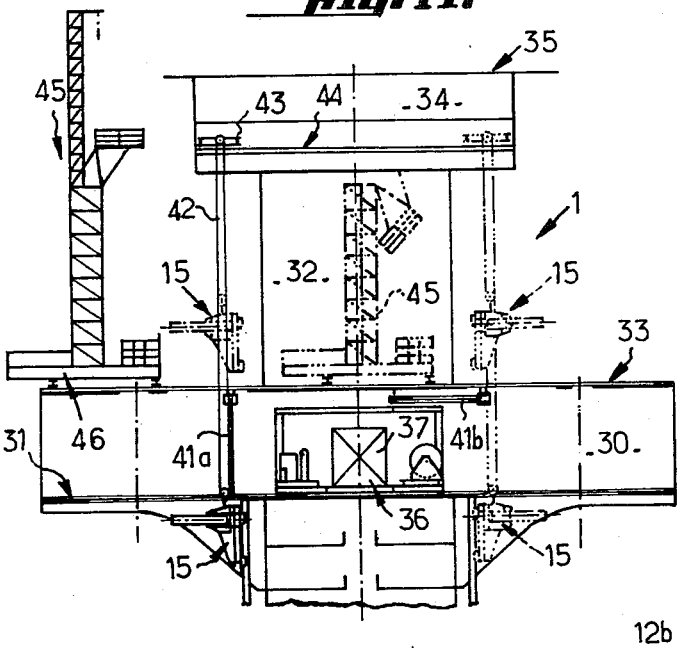
Figure 13:
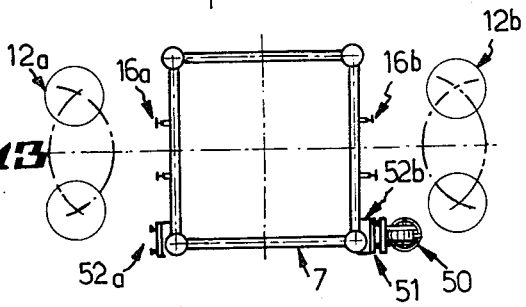
Figure 15:
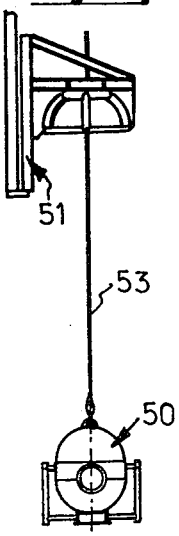
Figure 14:
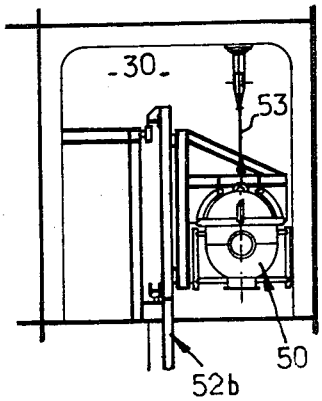
Figure 16:
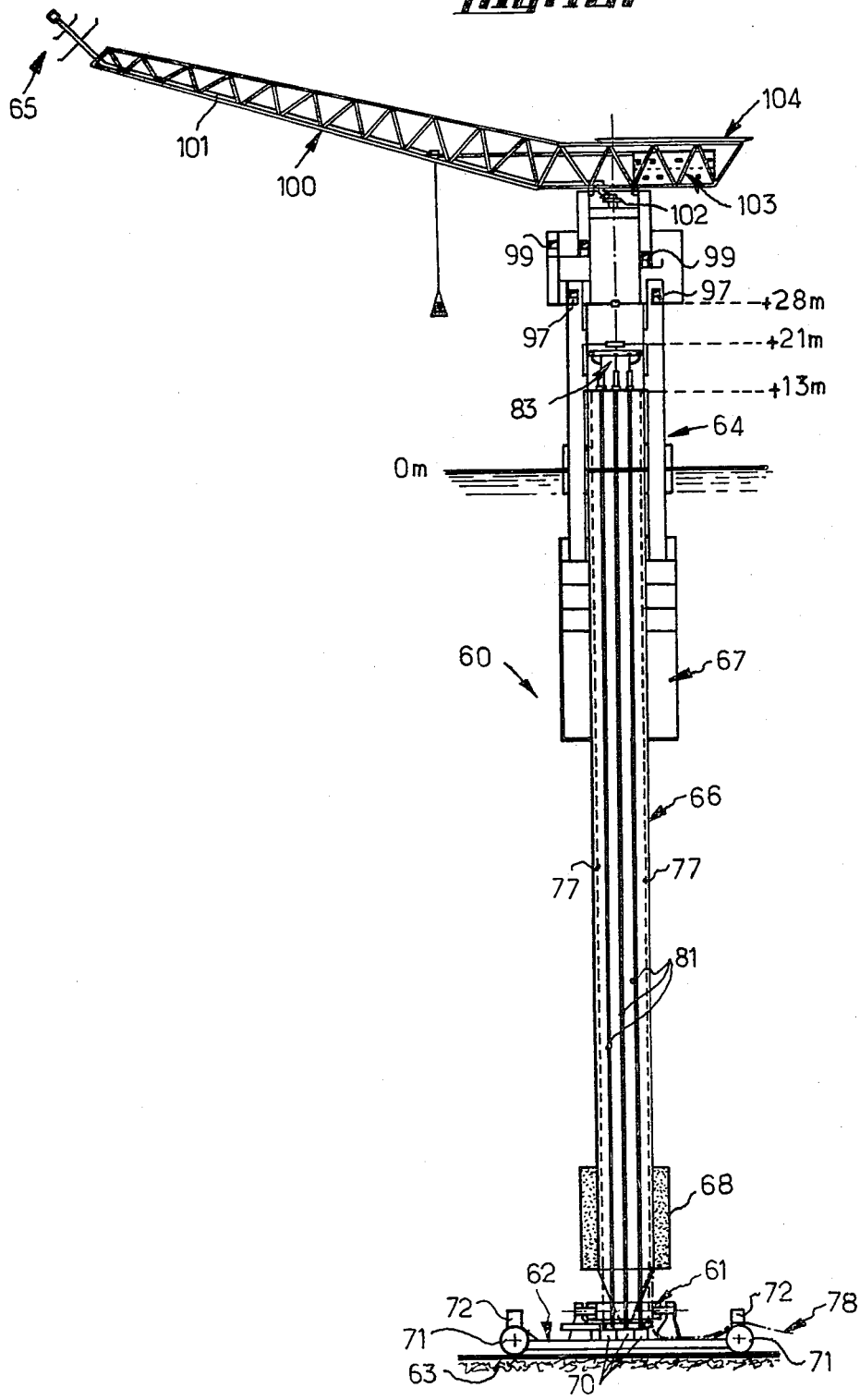
Figure 17:
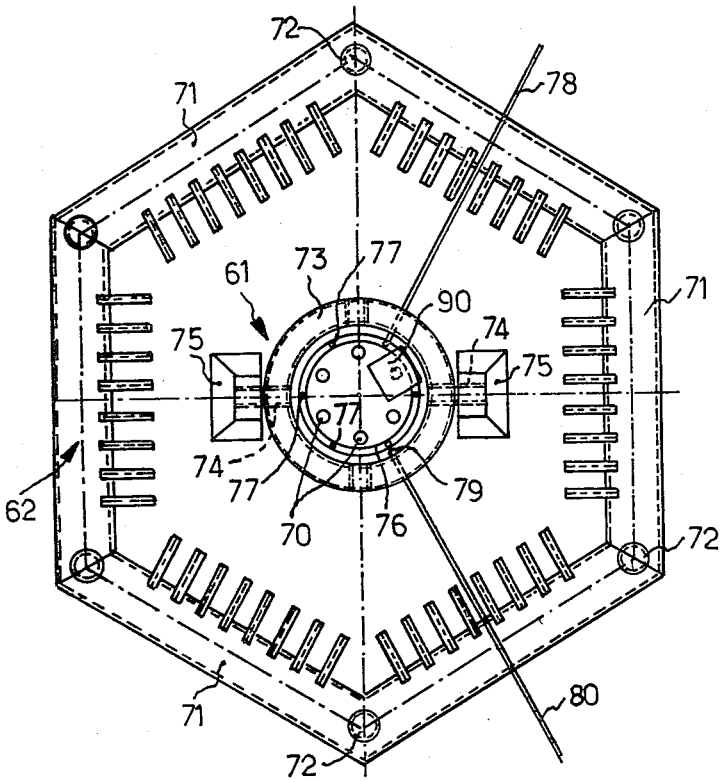
Figure 18:
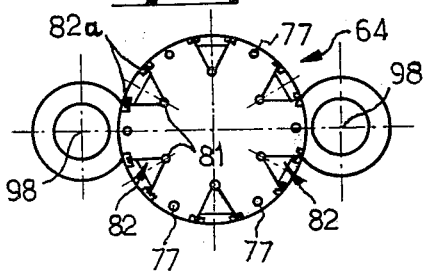
Figure 19:
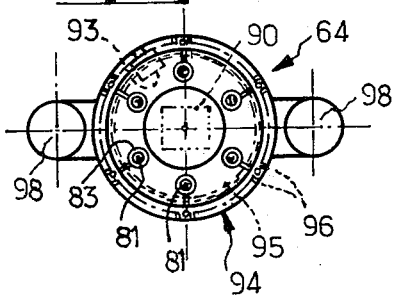
Figure 20:
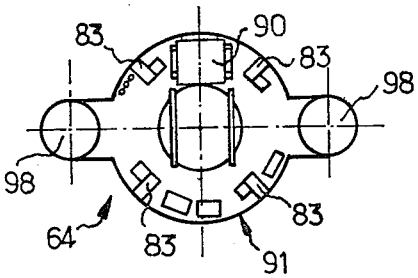
Figure 22:
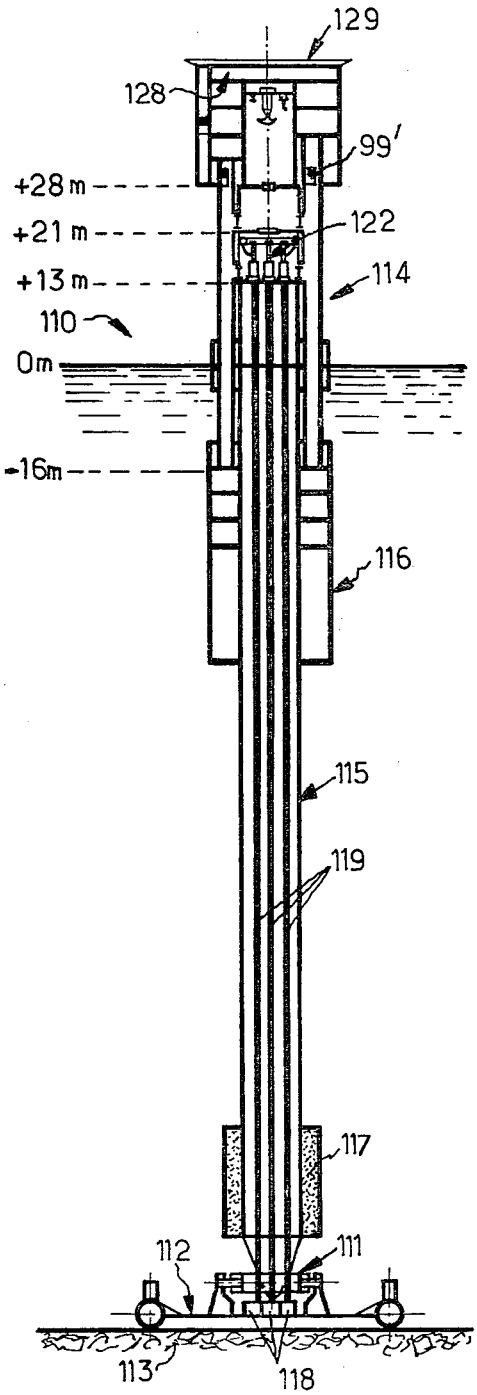
Figure 21:
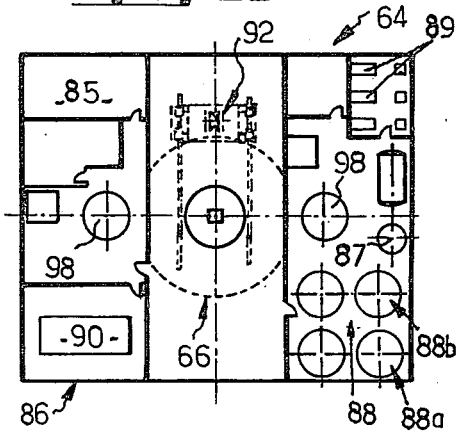
Figure 23:
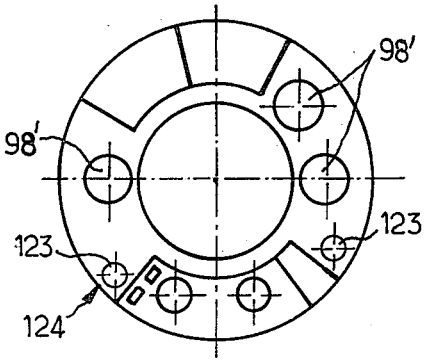
Figure 24:
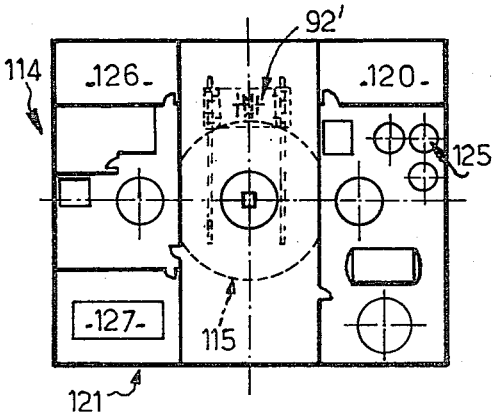
Figure 25:
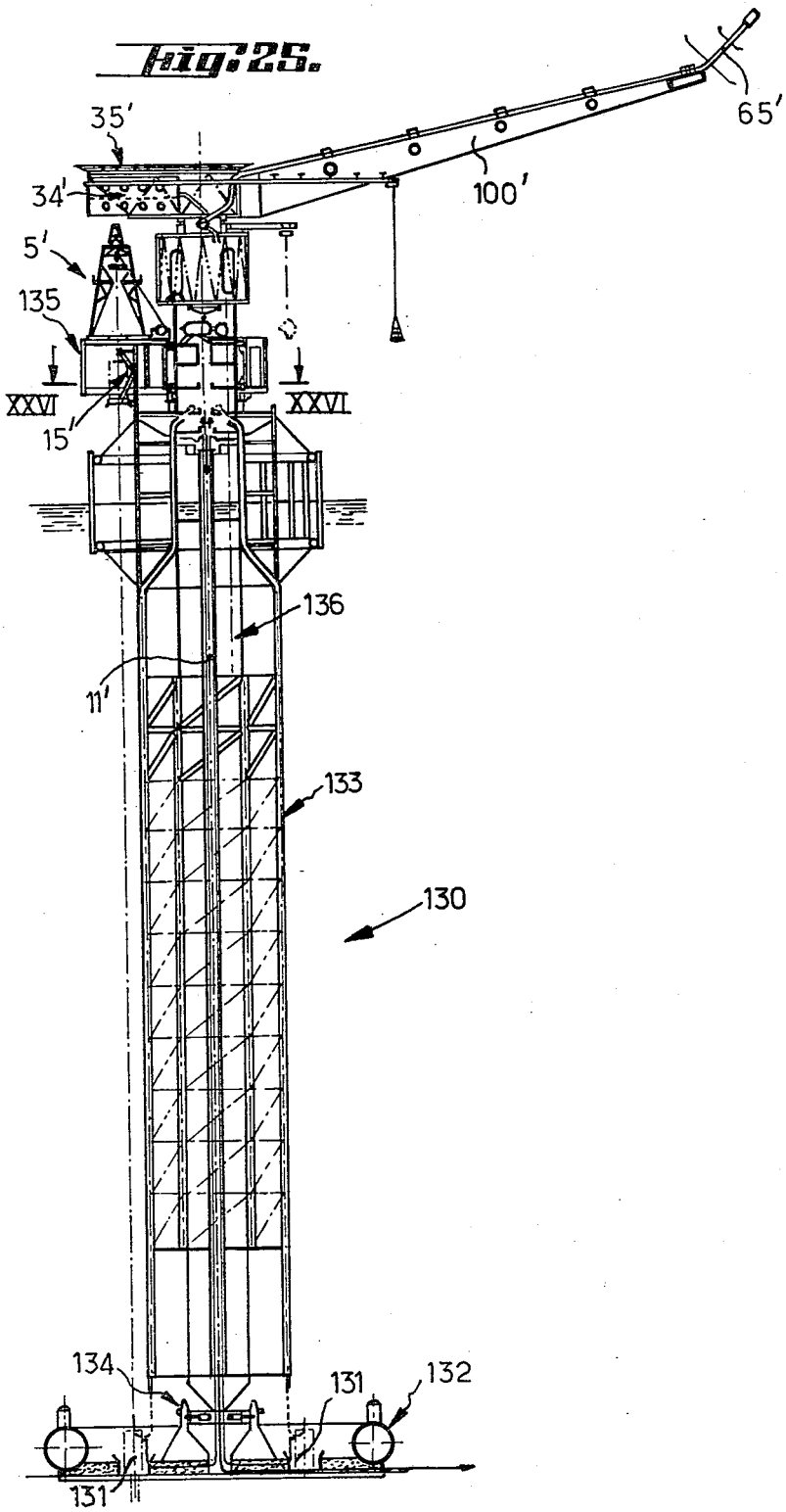
Figure 27:
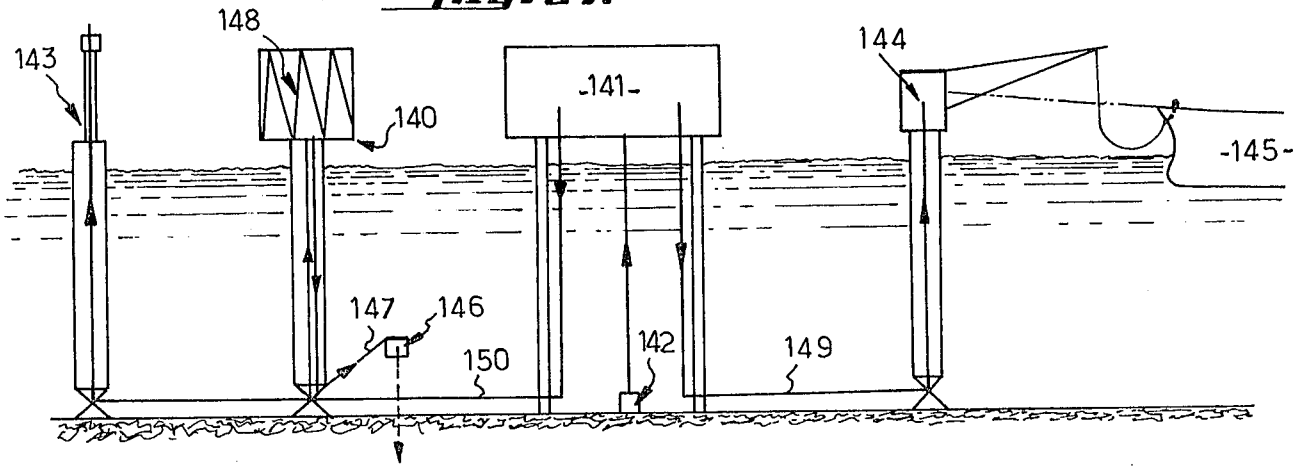
Figure 26:
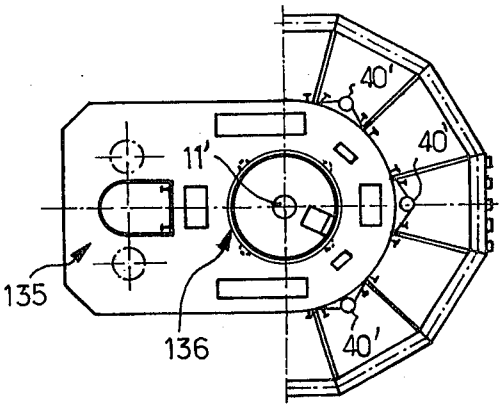
Figure 31:
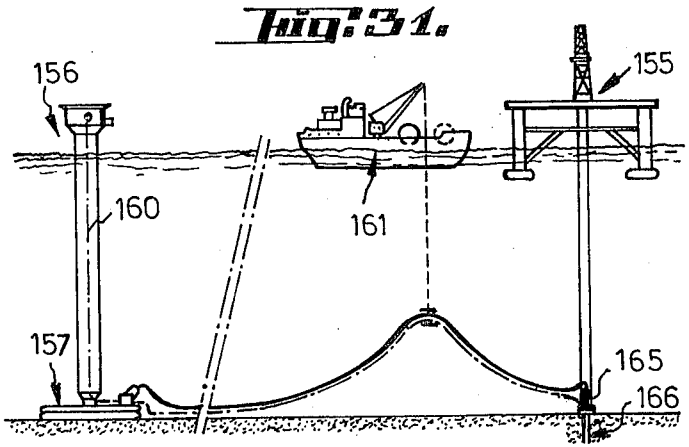
Figure 32:
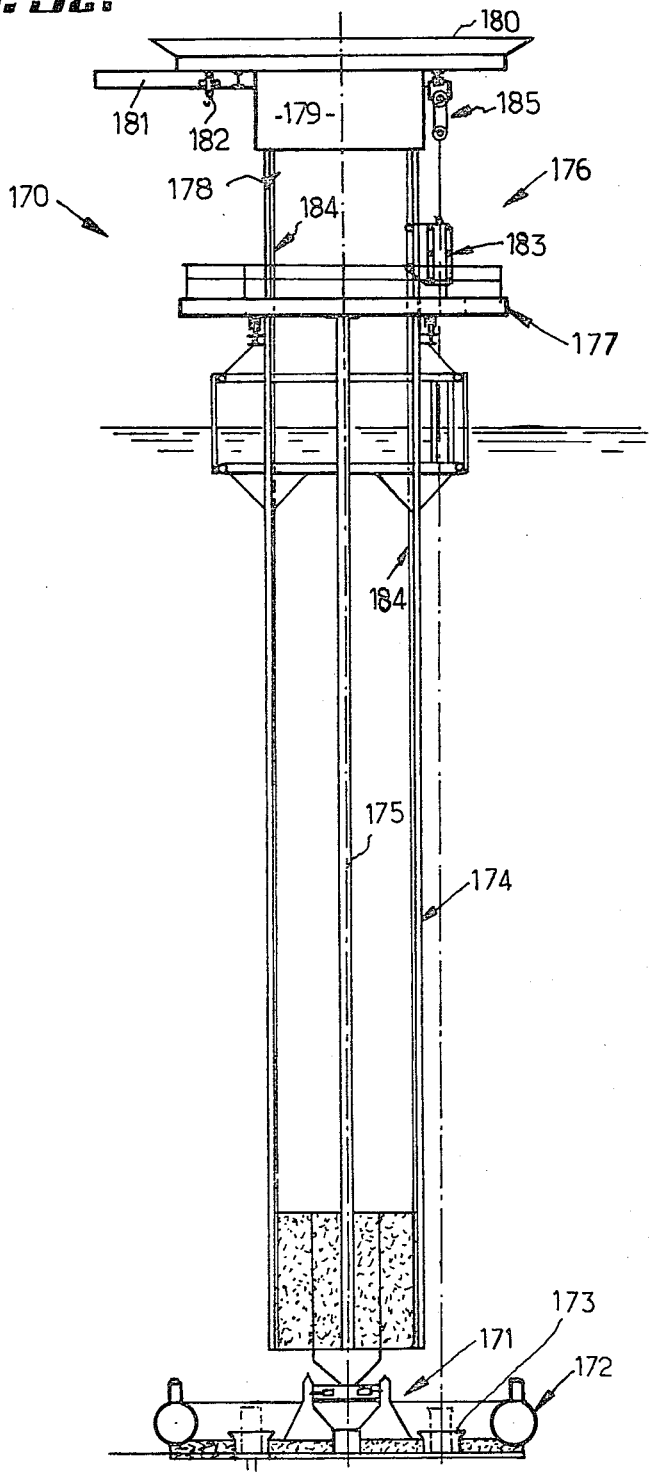

Other advantages, characterizing features and details will appear more clearly from the following explanatory description made with reference to the appended drawings, given solely by way of example and wherein:

FIG. 1 is a longitudinal sectional, elevational view of an articulated column according to the invention ensuring the reconditioning and maintenance of underwater well-heads clustered in its base outside the horizontal apparent contour of the column, this view corresponding also to the sectional view upon the line I—I of FIG. 5, FIG. 2 is a sectional view upon the line II—II of FIG. 5, FIG. 3 is a top view of the base of the articulated column represented in FIG. 1, illustrating the distribution of the underwater well-heads, FIG. 4 is a sectional view upon the line IV—IV of FIG. 1, FIG. 5 is a sectional view upon the line V—V of FIG. 1, FIG. 6 is a partial top view of a level of the emerging portion of the column, illustrating a conduit tensioning device associated with a movable skid, FIG. 7 is a fragmentary top view of a guiding carriage movable along the column and outside the latter, and intended to support the intervention tools, FIG. 8 is a partial side view illustrating the movable carriage of FIG. 7 on the emerging portion of the column, FIG. 9 is a view in the direction of arrow IX of FIG. 8, FIG. 10 is a partial elevational view of the bottom portion of the column with the movable carriage bringing an intervention tool on a well-head, FIG. 11 is a partial elevational view of the emerged upper portion of the column, FIG. 12 is a partial, longitudinal sectional view of the column represented in FIG. 1, diagrammatically showing a diving device associated with the column, FIG. 13 is a sectional view upon the line XIII—XIII of FIG. 12, FIG. 14 is a sectional view upon the line XIV—XIV of FIG. 12, FIG. 15 is a view substantially identical with FIG. 14, but with the diving device located at the lower portion of the column, FIG. 16 is an elevational, longitudinal sectional view of an articulated column according to the invention ensuring in particular the operations involved in production, reconditioning and maintenance of the well-heads clustered in its base, as well as the burning of the gases, FIG. 17 is a top view of the base of the articulated column represented in FIG. 16, FIG. 18 is a sectional view at the O-meter level (water surface) of the articulated column represented in FIG. 16, FIG. 19 is a sectional view at the +13-meter level of the ariculated column represented in FIG. 16, FIG. 20 is a sectional view at the +21-meter level of the articulated column represented in FIG. 16, FIG. 21 is a sectional view at the +28-meter level of the articulated column represented in FIG. 16, FIG. 22 is an elevational, longitudinal sectional view of an articulated column according to the invention, intended to perform in particular the operations involved in the injection of water into productive layers of the sea-bed, as well as the reconditioning and maintenance of the underwater well-heads clustered in its base within the horizontal apparent contour of the column, FIG. 23 is a sectional view at the −16-meter level of the column represented in FIG. 22, FIG. 24 is a sectional view at the +28-meter level of the articulated column represented in FIG. 22, FIG. 25 is an elevational, longitudinal sectional view of an articulated column according to the invention, ensuring in particular the operations involved in production, reconditioning and maintenance of the underwater well-heads clustered in its base outside the horizontal apparent contour of the column, as well as the burning of the gases, FIG. 26 is a partial sectional view upon the line XXVI—XXVI of FIG. 25, FIG. 27 is a diagrammatic view illustrating a structure for exploiting the sea-bed, including particularly an articulated column for gas injection into the productive layers through an isolated underwater well-head, FIGS. 28 to 31 are longitudinal sectional views diagrammatically illustrating the method of connecting an articulated column for injecting water into an underwater well-head, associated with a production column, and FIG. 32 is an elevational, longitudinal sectional view of an articulated column according to the invention intended particularly for the protection of underwater well-heads clustered in its base outside the horizontal apparent contour of the column, as well as the beaconing or marking and maintenance of the said heads.

The underwater well-head reconditioning and maintenance column 1 represented in FIGS. 1 and 2, is jointed by means of a universal joint 2 of the Cardan type to a base 3 resting on the sea bed 4. The column 1 comprises essentially an emerging portion or head 5 where the equipment necessary for conducting all the underwater well-head reconditioning and maintenance operations is concentrated, a casing or stack 6, e.g. cylindrical in shape, partially submerged and prolonged by a lattice structure 7 of square section connected at its bottom to the universal joint 2. On the upper portion of the lattice structure 7 is provided a main float 8 usually divided into independent compartments and which produces an uprighting torque in case of tilting of the column under the action of external forces. On the lower portion of the tubular lattice structure 7 are provided auxiliary floats 9 for towing and submerging the column, as well as a ballast compartment 10 located above the universal joint 2 to reduce the vertical force on the said joint due to the thrust of the main float 8. Along the axis of column 1, between its base 3 and head 5, is provided a central well 11 for the passage of the fluid flow lines and the well-head remote-control lines.

Referring more particularly to FIGS. 3 and 7, the underwater well-heads 12 are advantageously clustered into two groups 12*a*, 12*b* opening at the base 3 outside the horizontal apparent contour of the column, which groups are for example in diametrically opposite relationship with respect to the axis of the said column. In each group 12*a*, 12*b*, the well-heads 12, e.g. five in number, are distributed along a circle whose centre is also located outside the horizontal apparent contour of the column.

Referring more particularly to FIGS. 1, 4, 5, 7 to 10, the column 1 is fitted with a single tool-carriage 15 movable along vertical guide-rails 16*a* and 16*b*, respectively, each mounted at one side of the column in a substantially vertical plane passing through the centres of the two groups of wells 12*a*, 12*b*. The guide-rails 16*a*, 16*b* extend between the head 5 and the base 3 of the column and are supported by the casing 6 and the lattice structure 7.

With the carriage 15 is associated a rotatable telescopic arm 17, a fixed endmost element of which is pivotally connected to the ends of the piston rods of two fluid-operated actuators 18 coplanar with the said arm in a substantially horizontal plane and the cylinders of which are pivotally connected to the carriage 15. The telescopic arm 17 is extendable by means of a fluid-operated actuator 19 and comprises, at the free end of its last movable element, a gripping member 20 such as tongs. Thus, the tongs 20 may be brought right above each well 12 of one or other well groups 12*a*, 12*b* according to whether the carriage is rolling on the rails 16*a* or 16*b*.

The descending motion of the carriage 15 along the guide-rails 16*a*, 16*b* (FIG. 7) is ensured by a suspension cable 21 wound on a winch 22, with a concomitant descending motion of an actuating connecting cable 23 associated in particular with the actuators 18 for positioning the arm 17. The connecting cable 23 is wound on a reel 24. The winch 22 and the reel 24 are located in a compartment 25 provided in the upper portion of the casing 6.

The head 5 of column 1 (FIGS. 1, 2, 12) comprises, starting from the upper end of its casing 6, a first workshop caisson 30 intended for storing in particular the heavy intervention appliances. The dimensions of the caisson 30 are such that it overhangs the two groups of wells 12*a*, 12*b*. The caisson 30 is surmounted by a second caisson 32, the base surface of which is smaller than that of the floor 31 of caisson 30, so as to define on the external upper surface of the latter an external working floor 33. The caisson 32 is surmounted by a caisson 34 containing the living quarters and the upper surface of which forms a platform 35 for helicopters. The base of surface 35 is of a size intermediate between those of the caissons 30 and 31.

Within the caisson 30 (FIGS. 6 and 11) is particularly provided a skid 36 movable in translation along guide-rails arranged on the floor 31 so as to be positioned in vertical alignment with the wells 12 of either the group 12*a* or the group 12*b*. The skid 36 (FIG. 11) supports for example a heavy tool such as a well obturating block 37. A tensioning system 38 with its cables 39 is provided to compensate for the weight and the vertical motions of an intervention pipe 40 (FIGS. 8, 10) connected at its lower end to one of the well-heads 12.

In the workshop caisson 30 are provided retractable vertical auxiliary guide-rails 41*a*, 41*b* extending substantially in prolongation of the guide-rails 16*a* and 16*b*, respectively, to allow the carriage 15 to enter the caisson 30 through openings provided in the floor 31 for the purpose of mounting at the end of its telescopic arm 17 the intervention tools stored in the said caisson.

At the caisson 30, the carriage 15 (FIG. 11) is displaceable by a cable 42 which also serves, through the medium of a pulley 43 and an overhead or traveling crane 44 supported at the lower portion of the caisson 34 containing the living quarters, to pass the carriage 15 from the guide-rails 16*a* onto the rails 16*b* and vice versa after the said carriage is raised out of the caisson 30 through openings provided at its upper portion.

On the working floor 33, at the upper surface of caisson 30, is mounted for example a drilling and lifting derrick 45 for vertical handling of tubular elements such as the intervention pipes 40. The derrick 45 is also displaceable through the medium of a carriage 46 so as to be positioned in vertical alignment with each group of wells 12*a*, 12*b*. The derrick 45 is advantageously retractable at its upper portion in order that it may be stowed within the caisson 32.

At the working floor 33 are also provided loading and unloading systems 47 allowing handling operations to be carried out between the column and a ship or like vessel (FIG. 2).

Referring to FIGS. 12 to 15, the column 1 is equipped with a diving set such as a bell 50 also guided along the column 1 by a carriage 51 movable on guide-rails 52*a*, 52*b* mounted in the same manner as the rails 16*a*, 16*b* of carriage 15. The bell 50 allows the operations being performed at the wells 12*a* and 12*b* to be supervised. The bell is lowered by a cable 53 from the workshop caisson 30. The guide-rails 52*a* and 52*b* for the bell 50 meet at shifting points so as to lead within the caisson 30 to allow the loading and unloading operations to be performed therein.

The column 1 which has just been described is an articulated column for integrated reconditioning and maintenance of underwater well-heads, which offers the following characteristics:

ten well-heads are clustered into two groups of five opening into the base and in diametrically opposite relationship with respect to the axis of the column (the number of well-heads is given by way of example);

access to the various wells is from working floors (located at the emerging portion of the column) vertically to each group of wells. Each well is reached by deviation from those floors by a remote-controlled tool-carriage guided along rails throughout the length of the column; The intervention tools (such as well obturating blocks, intervention pipes, connectors) are loaded at the caissons located in the emerging portion of the column;

all heavy handling and intervention means are displaceable on the working floors to be positioned in vertical alignment with each of the groups of wells.

To be mentioned in addition to the above-described equipment and appliances are the internal equipment and utilities.

As a general rule, all testing and checking or control equipment, stored materials (such as mud, cement, fuel) are located in the upper portion of casing 6. Worthwhile mentioning among such equipment is the presence of a testing separator having a capacity of for example twenty thousand barrels per day, allowing the fluid flowing from any one of the wells, whether producing or not, to be analyzed, the connection between the separator and the well-heads being through the central well 11 of the column.

The utilities (such as power, water, living quarters) and the safety means are arranged mainly in the caissons located in the upper portion of the column.

Given for example a well obturating block 37 to be moved down to a well 12 of the group 12*a*. In a first stage, the well obturating block 37 mounted on its skid 36 is moved to the workshop caisson 30 into vertical alignment with the group of wells 12*a*. Thereafter the carriage 15, for example already located on the same side as the group of wells 12*a*, is introduced into the caisson 30 through the medium of the cable 42 associated with the traveling crane 44. In the caisson 30, the arm 17 of carriage 15 can then be connected through a pipe 40 to the lower end of which is secured the well obturating block 37. Thereafter the block 37 is moved down to the well-head by being guided through the medium of the carriage 15 rolling on the guide-rails 16*a* under the action of cable 21 which has replaced the cable 42. As the well obturating block 37 is lowered, elements of pipes 40 are assembled to one another, the said elements being handled by means of the lifting tower 45.

The operation which has just been described is one of those which such a column can perform. Among other operations mention can be made of the one consisting in killing a well by mud injection, the one consisting in changing a well head by means of the lifting tower 45, and so forth.

The design of the column is such that its adaptation for use at depths reaching 400 meters can be contemplated. When the intervention on the well-heads is over, the column can be disconnected from the base in order to be towed to another intervention site.

Referring now to FIGS. 16 to 21, there will be described an articulated column for performing particularly such operations as are involved in production, well-head reconditioning and maintenance, as well as gas burning and/or conveying e.g. to another column.

The column 60 now considered is jointed by means of a universal joint 61 of the Cardan type to a base 62 resting on the sea-bed 63. The column 60 comprises an emerging portion or head 64 where are concentrated in great part the equipment and plants serving to perform the above-mentioned operations, flare means 64 a casing 66 extending from the head 65 down to the lower end of the column, the main float 67 divided into suitably fitted-up compartments, and a ballasting compartment 68 provided around the lower portion of the column.

In the case of the column 60 considered, the underwater heads 70 are concentrated at the base 62 along a circle the centre of which coincides with the axis of the column and the radius of which is smaller than that of casing 66 to allow vertical access from the head 64 of the column to each of the wells through the interior of the Cardan joint 61.

The base 62 of the column considered is for example hexagonal in shape and constituted by six floats 71 serving to obtain a zero apparent weight in the water during submersion. Fine control for obtaining this is by means of six pipes 72 located at the vertices of the hexagonal arrangement.

The Cardan joint 61 comprises a ring 73 pivotally connected to the column and the base, along two perpendicular axes, respectively, by retractable, hydraulically controlled pins 74 received in corresponding bearings 75, in a manner known per se.

At the base 62 is provided an annular collector 76 into which open descending lines 77 conveying the oil processed in the column head, the said lines descending along the casing. The collector 76 is connected to an external line 78 serving to convey the oil to a loading station.

Within the column casing 66 passes at least one line 79 for the conveyance of gas intended for example to be carried through a line 80 to another column, for example for the supply of power thereto. Ascending lines or production lines 81 associated with the well-heads 70, respectively, convey the oil to the column head 64 for its processing. It should be noted that all these lines are flexible in the region of their passage through the Cardan joint so as to be independent of the articulation.

The said lines, in particular the production lines 81, are protected within the casing 66 by coverings or the like (not shown) allowing their sliding motion and guiding to the +13-meter level with respect to the sea surface. The coverings themselves are guided and maintained in position by means of slides 82 movable along guide-rails 82*a* throughout the length of the column (FIG. 18).

Each production line 81 is suspended from a hydraulic tensioner 83 which compensates for the weight and vertical sliding motions of the lines (FIG. 20).

At the top of the production lines 81 are placed flow heads (not shown) connected to a distributor 85 through the medium of a high-pressure hose and a fixed piping. The distributor 85 is located at the +28-meter level of the column (FIG. 21).

A production unit 86 is located at the +28-meter level and comprises in particular:

a testing separator 87, two sets 88 of separators 88*a*, 88*b*, loading pumps 89.

At this level is also provided a unit 90 for remote-control of the wells 70.

To allow the carrying out of, in particular, the operations necessary for reconditioning and maintenance of the well-heads 70, the column 60 is fitted at its emerged head 64 with a whole set of intervention equipment supported by working floors located at different levels and all provided with a central opening in prolongation of the casing 66 to allow free circulation. For the handling of the elements of the production lines 81 is provided a travelling crane (not shown) movable for example on a circular beam to allow a winch for supporting the said elements during their descending motion to the well-heads to be positioned vertically to each well 70.

The column 60 is provided with a well obturating block 90 stored on a floor 91 located at the +21-meter level (FIG. 20). To allow the block 90 to be aligned with the axis of the casing 66, there is provided a travelling crane 92 moving radially at the lower surface of the production unit located at the +28-meter level (FIG. 21).

A carriage 93 for guiding the block 90 (FIG. 19) is placed under a floor 94 located at the +13-meter level. The carriage 93 can be displaced along a circular path through the medium of a circular rail 95 to allow the block 90 to be positioned vertically to a well 70 which it is desired to service. The carriage 93 is guided during its descending motion to the vicinity of the base by rails 96 secured to the casing 66 and associated with each well-head 70. The carriage 93 supports an articulated arm (not shown) which can be caused to swing by means of a fluid-operated actuator to move the block 90 from the axis of the column to the axis of the well. The column 60 is also provided with a mud pumping equipment with a forcing unit and a sucking unit, as well as a cementing unit for performing well killing operations. This equipment as well as auxiliary equipment for the supply of the column with energy are arranged between the head 64, the upper portion of the casing 66 and the main float 67 of the column.

To allow in particular crew and equipment transfers between the −16-meter and +28-meter levels of the column use is made of elevators 97 moving outside the column (FIG. 16). Between the different levels located in the head 64 are provided cages 98 for the passage of elevators 99. These cages may also be used for the passage of conduits.

At the top of the head 64 is provided a rotatably mounted boom 100 in the form of a triangular lattice structure supporting a conduit 101 conveying the gas to the flaring means 65 (FIG. 16). Since the boom 100 is movable in rotation, the conveying conduit 101 is pivotally connected by a joint 102 to the fixed upper portion of the head 64. Living quarters 103 and a helipad 104 are provided at the top of the head 64 of the column and are jointly rotatable with the boom 100 which may extend over a distance of about 100 meters.

Such a column allows the following operations to be performed:

the clustering of several underwater well-heads on its base, the protection and guiding of the ascending production lines up to the separation unit provided in the column head, the accommodation of a production unit for processing the extracted oil, the discharge of crude oil towards, for example, a loading column, the flaring of the gas proceeding from the separation unit by means of freely rotatable flaring means located at the top of the column, the maintenance, instrumentation and changing of the underwater well-heads, the accommodation of the equipment necessary for the reconditioning operations (lowering of a well obturating block, mud storing, changing of production lines, etc), the accommodation of auxiliary equipment such as a diving unit, a travelling crane for handling equipment between the column and a ship, a helipad and living quarters.

Referring to FIGS. 22 to 24, there will now be described an articulated column allowing in particular the following operations to be carried out: water injection into the production layers of the sea-bed, maintenance and reconditioning of underwater well-heads.

The column 110 is connected through the medium of a universal joint 111 of the Cardan type to a base 112 resting on the sea-bed 113. The column comprises an emerging portion or head 114 where is concentrated at several levels the whole of the equipment and plants allowing the aforesaid operations to be performed, a casing 115 extending from the head 114 to the lower end of the column, a completely submerged main float 116 divided into compartments and a ballasting compartment 117 mounted at the lower end of the column.

For this column 110 the underwater well-heads 118 are clustered on the base 112 along a circle the centre of which coincides with the axis of the column and the radius of which is smaller than that of the casing 115 so as to allow direct vertical access from the upper portion or head 114 of the column to each of the wells 118 through the interior of the joint 111. This arrangement therefore offers the advantages of a fixed platform, namely: direct access to the well-heads (safety unit and production unit) located at the surface, owing to the fact that the production unit is directly accessible at the surface on the column while at the same time allowing vertical access in the column to the safety units and within the wells which are located at the bottom, for their maintenance.

The base 112 is constituted in an identical manner with that of the column 60 described previously (FIG. 17).

From each of the well-heads 118 extends an ascending conduit 119 constituted by elements mounted end to end and which extends substantially to the +13-meter level. Thereafter, a connection is established by a high-pressure hose and then by a fixed piping to a distributor 120 located at the +28-meter level of the column (FIG. 24). The distributor 120 forms part of a processing unit 121.

It should be noted that at their passage through the Cardan joint 111 the water injection conduits 119 are flexible. Moreover, they are guided in the column in the same manner as production lines 81 of column 60 described previously (FIG. 18). The water injection conduits 119 co-operate at their upper portion with a tensioning system 122 (FIG. 22).

The column 116 is equipped with a water injection unit comprising essentially:

sea-water supply pumps 123 supported by a floor 124 located at the −16-meter level of the column. The sea-water inlets, e.g. two in number and in diametrically opposite relationship, are bored in the main float (FIG. 23), the sea-water processing unit 121 located at the +28-meter level. The unit 121 comprises particularly (FIG. 24) filtering means 125 and injection pumps accommodated in a room 126.

At the level of the processing unit 121 is also provided a unit 127 for remote-control of the whole set of wells 118.

The column 116 also comprises all the equipment necessary for the reconditioning and maintenance of the well-heads 118. This equipment is of the same type as the one described previously in connection with column 60. Consequently, the same reference numerals have been used in FIGS. 22 to 24 with the addition of the sign "prime", as for example the travelling crane 92' (FIG. 24) for handling a well obturating block and the cages 98' of the elevators 99'. The levels represented in FIGS. 19 and 20 for the previously described column 60 are identical with those of the water injection column 114 and are therefore not described here. At these levels are located particularly the means for handling heavy intervention tools.

The column 114 is also equipped, as the previous column, with means for obturating a well-head 118 by means of mud stored in tanks and with auxiliary equipment provided particularly for the supply of the column with energy. Gas supply can be provided from the previous production column which is connected to column 114 through the conveying conduit 78.

At the top of column 114 are provided living quarters 128 surmounted by a helipad 129.

Such a column therefore allows the following functions to be performed:

clustering of several underwater well-heads on its base, protection and guiding of the water injection conduits, accommodation of the water injection unit, maintenance, instrumentation and changing of the underwater well-heads, accommodation of the equipment necessary for the well-head reconditioning operations (lowering of the well obturating block, mud storing, changing the injection conduits, etc), accommodation of auxiliary equipment, accommodation of living quarters for, for example, 40 persons.

Referring to FIGS. 25 and 26, there will now be described an articulated column 130 for performing particularly the operations involved in production, underwater well-head maintenance and reconditioning, as well as flaring and/or conveying of the extracted gases. The column 130 is similar to the column 60 described previously, for it performs substantially the same operations, but differs therefrom by the fact that the underwater well-heads 131 are clustered on the base 132 of the column along a circle centered on the axis of the column and the radius of which is greater than that of the body or casing 133 of the column. Otherwise stated, the well heads 131 are located outside the horizontal apparent contour of the joint 134 between the column and the base, instead of inside as in the case of the column 60 described previously. The column 130 comprises substantially the same equipment as the column 60 as regards particularly the gas burning and production operations. Since the well-heads 131 are outside the horizontal apparent contour of the column, the equipment for the well-head maintenance and reconditioning operations is substantially identical with that of the column 1 (FIG. 1) described previously. Therefore, the same reference numerals as those of column 1 and column 60 are used in FIGS. 25 and 26, simply adding the sign "prime".

The column 130, however, comprises a few modifications compared particularly to the column represented in FIG. 1. Indeed, the handling derrick 5' is supported by a caisson 135 which, instead of being fixed like the caisson 30 of column 1, is mounted rotatably about the upper portion of the casing 136. Consequently, it is not necessary to provide a travelling crane for placing above each underwater well-head 131 the tool-carriage 15 movable along the column.

Referring to FIG. 27, there will now be described a gas reinjection column 140 forming part of a sea-bed exploitation structure which comprises in particular a production column 141, either articulated or not, associated with at least one underwater well-head 142, an articulated column or flaring column 143 for burning part of the gases from the production column 141, and an articulated column 144 for loading for example a tanker 145 with oil.

In this example, the well-head 146 from which gas reinjection into the production layers is to be effected is an isolated well-head connected to the gas reinjection column 140 through an underwater line 147.

The very-high pressures necessary for reinjecting gas into the underwater well-head 146 and the hazard of explosion inherent in the gas make it necessary for the gas treating equipment 148 to be placed in naturally aerated areas, i.e. in the column head placed above the levels of the highest waves.

The dimensions and weight of the equipment 148, especially that of the dehydration and compression equipment, vary in great proportions depending on the condition of the gas arriving at the column 140 and the reinjection pressure.

In the example illustrated in FIG. 27 and according to a usual arrangement, the production column 141 processes the effluent from the underwater production well-head 142 so as to separate the different faces of the effluent, particularly oil, which is thereafter conveyed to the loading column 144 through an underwater line 149, and gas, which is carried by an underwater line to the flaring column 143.

In view of the fact that, as the exploitation of an underwater oil site proceeds, it is necessary to either inject water or inject gas into the production layer to maintain a certain pressure therein, the gas (in the case of gas injection as in the example considered) may advantageously be the one extracted from the producing layers, which means that, in fact, gas reinjection is effected through the medium of auxiliary underwater well-heads (147) which preferably are not located in immediate proximity to the producing well-heads (142). Since, moreover, the flaring of gas resulting from the exploitation of the producing layers is being increasingly prohibited by regulations, use can advantageously be made of a gas-reinjection articulated column located in proximity to or on the reinjection underwater well-heads.

In this example, the gas reinjection column 140 is mounted between the production column 141 and the flaring column 143. Of course there may be cases where the flaring column 143 is maintained, that is to say part of the gas is flared nevertheless. Thus, the gas proceeding from the production column 141 is retreated in equipment 148 of the gas reinjection column 140 before being conveyed into the reinjection well-head 147. Moreover, there may be cases where the gas from the production column 141 is also commercialized.

As a result of the incorporation of this gas reinjection column in a sea-bed exploiting structure, preferably sufficiently far from the production column and the living quarters, the safety conditions of the exploitation are improved. Moreover, no stoppage is necessary at the production column for the drilling of the wells and the installation of the gas reinjection column.

The gas reinjection column 140 may advantageously receive auxiliary equipment, particularly those intended for killing a reinjection well. It should also be noted that the gas from the production column 141 may also serve as a source of energy for the equipment used on the gas reinjection column 140.

Referring now to FIGS. 28 to 31, there will be described a structure for sea-bed exploitation comprising particularly a production column 155 and a water injection column 156, as well as a connection method ensuring power (gas) supply to the water injection column 156 from the production column 155.

As mentioned previously, it may be necessary to either inject water or reinject gas into the productive layers, depending of course upon the constitution or structure of the layers. In the case of water injection, it must also take place sufficiently far from the production wells to avoid the injected water flowing directly into the production well-heads. The injected water, which initially is sea-water, is treated in the same manner as it is in the water injection column 110 described previously (FIG. 22) and, in particular, it must be only slightly oxygenated in view of the corrosion problems involved.

The column 156 is an articulated column that meets these conditions. After being towed and placed either vertically or in proximity to at least one well-head, it is jointed to a base 157 resting on the sea-bed.

Figure 28:
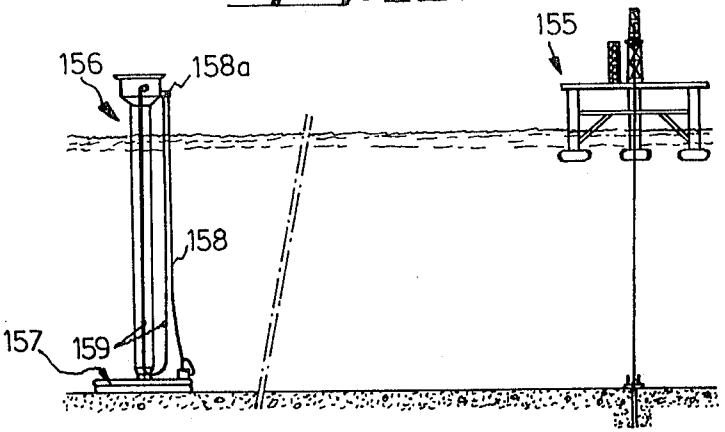

In addition to the internal equipment of the column allowing it to perform its own function it comprises a high-pressure flexible pipe 158 intended to be connected to the production column 155, the said flexible pipe opening outside the column substantially at the base 157 and being connected at its other end to a removable connector **158*a* assembled to the emerging portion of column 156. The portion of the flexible supply pipe 158 which is located within the column is not shown. The column 156 is also provided with a cable 159 passing through the casing of the column and then outside the column back to the removable connector 158*a* (FIG. 28**).

Figure 29:
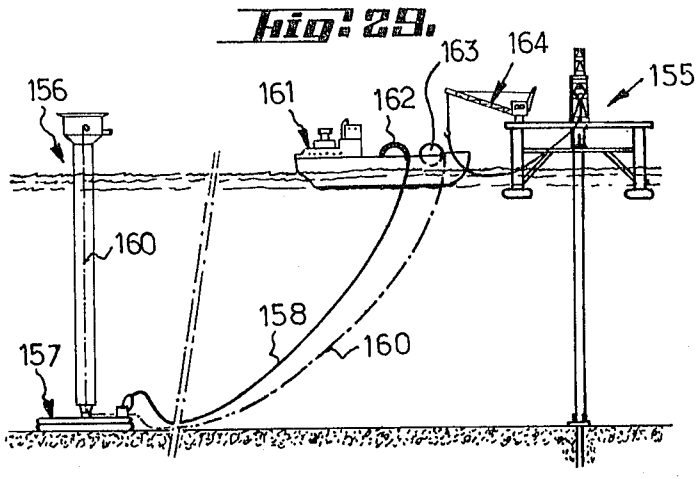

The connection between the water injection column 156 and the production column 155 will take place through the medium of a ship 161. The latter is advantageously equipped with two reels 162, 163. On the reel 162 is wound a high-pressure flexible pipe, one end of which will be connected to the high-pressure flexible pipe 158 of the water injection column. On the reel 163 is provided an operating cable 160 which will be connected to the end of the cable 159 connected to the connector **158*a*, and allowing the operating cable 160 to be engaged into the column 156 through the submerged lower end of the latter (FIG. 29**).

The ship 161 thereafter moves towards the production column 155 with concomitant unrolling of the cables from the reels 162 and 163.

Figure 30:
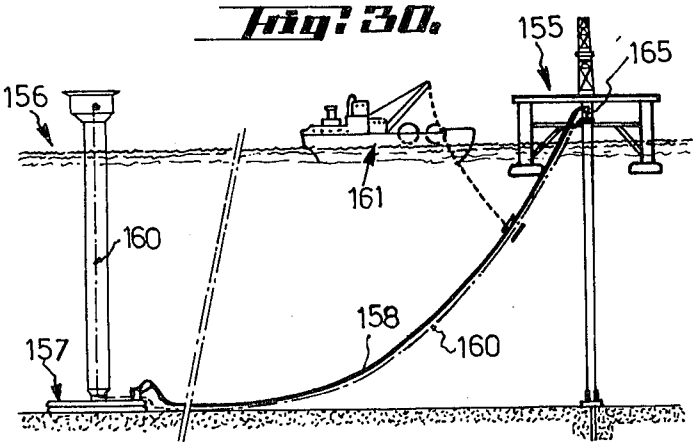

After the ship has reached a point in proximity to the production column 155, the flexible elements 158 and 160 are taken by a handling crane 164 of the column 155 to allow them to be connected in the upper portion of the production column 155 to a well-head 165 (FIG. 30). At this stage, tests are carried out to check the connections and then the well-head 165 is lowered onto the production well 166 (FIG. 31).

In the example illustrated, the production column 155 is in fact a semi-submersible platform where the production units are located at the well-head 165. In the case of an articulated production column, the gas is treated in the column itself before being conveyed to the water injection column 156.

It is important to note that all the connections are effected at the surface and do not therefore require any diving equipment.

Referring to FIG. 32, there will now be described a last type of articulated column 170 which may be used in a structure for sea-bed exploitation. Such a servicing column can particularly perform the following functions:

- supporting and protecting a set of well-heads placed within its base,
- beaconing or marking-out the whole set of well-heads to prevent floating devices from passing over them and to indicate their location,
- supporting of well-head control equipment (control lines, electro hydraulic unit, multiplex system, etc),
- the working and supporting area for the equipment necessary for carrying out the following works: cable work, systematic raising to the surface, for control and servicing purposes, of the safety valves placed on each well-head, raising to the surface, for checking and servicing purposes, of the upper portion of the well-heads, supporting of the diving equipment necessary for inspection and servicing of the well underwater equipment.

It is to be noted that these operations are also performed by the columns described above, where the operations involved in the maintenance and reconditioning of the underwater well-heads have been mentioned.

The servicing column 170 is connected to a base 172 through the medium of a universal joint 171 of the Cardan type. At the base 172 open underwater well-heads 173 distributed along a circle centered on the axis of the column and the radius of which is greater than that of the main structure of the column constituted by a cylindrical casing 174. Otherwise stated, the well-heads 173 can be reached vertically outside the column.

In the cylindrical casing 174, along the axis of the column, is provided a well 175 for the passage of the protective pipes of the well-head control lines.

On the emerged upper end of casing 174 is mounted a rotary head 176 composed of a working floor 177 surmounted by a lattice structure 178 supporting a caisson 179 containing the living quarters and surmounted by a helipad 180.

The column head 176 is equipped for example with an overhead or travelling crane 181 located under the platform 180 and comprises a handling winch 182 for carrying out transhipment or transfer operations for example with a ship.

The column 170 is also fitted with a carriage 183 movable along the column, outside the latter, through the medium of guide-rails 184. The carriage 183 allows a well head 173 to be guided from the lower portion of the column to the working floor 177 for checking purposes. The carriage 183 is connected by a cable to a pulley block or reeving 185 mounted at the lower surface of the platform 180. There are as many guide-rails 184 as there are well-heads 173.

The column is also equipped with intervention conduits or lines allowing one of the well-heads 173 to be connected to the head 176. These conduits are mounted end to end, with the lower conduit supporting a tool for disconnecting for example the upper portion of the well-head which must be thereafter raised to the surface for checking. The lowering of these conduits is performed from the working floor 177 through the medium of a winch (not shown) for example normally stowed in the casing 174 of the column and raised onto the floor 177 during a servicing intervention. The said conduits may also be used for water injection into the wells for the purpose of reducing the head pressure before any intervention.

Such a column is of simple and light structure allowing for rapid intervention on the well-heads which must be checked at regular intervals.

In the case of the last-described column, it has been assumed that the well-heads open into the base outside the column, but they may of course open inside, in which case the intervention operations are performed from within the casing 174 of the column.

The various types of columns which have just been described can advantageously be used in structures for sea-bed exploitation singly, but preferably in combination so as to allow independent exploitation of an oil-field.

Of course the invention is by no means limited to the forms of embodiment described and illustrated, which have been given by way of example only. In particular, it comprises all means constituting technical equivalents to the means described as well as their combinations should the latter be carried out according to its gist and used within the scope of the following claims.

What is claimed is:

1. A structure for sea-bed exploitation allowing various functions of such exploitation to be performed in connection with well-heads clustered into at least one group in the sea-bed, such, for example, as production, reconditioning and maintenance of said underwater well-heads, and water or gas injection into the productive layers of the sea-bed, said structure comprising: at least one articulated emergent column having a body with a submerged and an emerging portion, said column being adapted to perform at least one of said functions and having associated therewith intervention or servicing means, such as a movable tool, adapted to be vertically alignable over to provide access to each of said well-heads, said intervention or servicing means being secured to and jointly movable with a support, said support being pivotally connected to a carriage, said carriage being movably mounted along guide-rails mounted adjacent to the horizontal apparent contour of the body of the said column.

2. An exploitation structure according to claim 1 and wherein said well-heads are clustered into two groups arranged in diametrically opposed relationship with respect to the axis of said column, characterized in that said column body has a configuration such that said well-heads are located outside the horizontal apparent contour of the body of the said column.

3. An exploitation structure according to claim 1 characterized in that said support is constituted by a telescopic arm mounted for pivoting in a substantially horizontal plane and two fluid-operated actuators, each mounted at one side of the said arm and in coplanar arrangement with respect thereto for pivoting said arm.

4. An exploitation structure according to claim 1, characterized in that the emerging portion of the said articulated column includes at least a first cassion having an upper and lower surface, said caisson being capable of storing the said intervention or servicing means and at least one of the lower surface and upper surface forming a working floor vertically overhanging the said well-heads to allow vertical access to each of the said well-heads from the said floor.

5. An exploitation structure according to claim 4 characterized in that at least some of the intervention or servicing means, particularly those of relatively considerable weight, are single and displaceable on the said floor so as to be located vertically over each of the said groups of well-heads.

6. An exploitation structure according to claim 5, characterized in that in the said caisson is stored at least one well obturating block displaceable on a movable skid so as to be located vertically over each of the said groups of well-heads.

7. An exploitation structure according to claim 4, characterized in that the said column includes a drilling and lifting or handling derrick or tower mounted on the said working floor and movable on the said floor so as to be located substantially vertically over each of the said groups of well-heads.

8. An exploitation structure according to claim 7 characterized in that the upper portion of the said derrick or tower is retractable so as to be accommodated within a second caisson surmounting the aforesaid first cassion.

9. An exploitation structure according to claim 4, characterized in that the aforesaid column comprises an upper caisson in which is provided a travelling or overhead crane for displacing the said movable carriage from one group of well-heads to another.

10. An exploitation structure according to claim 9, characterized in the said carriage is storable within the said first caisson.

11. An exploitation structure according to claim 1, further including diving equipment such as an intervention or servicing and supervising bell displaceable along the column by being guided by a movable carriage along guide-rails locatable in proximity to each of the said groups of well-heads.

12. An exploitation structure according to claim 11, characterized in that the said rails join together substantially in the region and within the said first caisson.

13. An exploitation structure according to claim 1, in particular for the maintenance and reconditioning of the said well-heads, characterized in that the said articulated column is equipped with means for testing, controlling, circulating the effluents and the stored materials such as mud, cement, fuel, located for example in the casing of the said column, on either side of a tidal compartment.

14. An exploitation structure according to claim 13, characterized in that the column is connected to the base by a rotary joint and the said equipment also comprises a testing separator for analyzing the effluent from any one of the said well-heads, whether producing or not, through the medium of a conduit line extending along the axis of the column and bending at the point of its passage through the rotary joint between the said column and its base.

15. An exploitation structure according to claim 14, is further including means for recombining and reinjecting the effluent, after it has been analyzed, into a production collector receiving the effluents from each of the said well-heads.

16. An exploitation structure according to claim 11, particularly for carrying out production operations, characterized in that at least one said well-head is connected through a production conduit line to a processing unit supported by the said articulated column, the latter also including at least one descending conduit line carrying the processed oil to, for example, a collector accommodated for example in its base and itself connected through an underwater conduit line to, for example, a loading column, and at least one descending conduit line conveying the gas extracted by the said processing unit and connected for example, by an underwater conduit line, to another column of the structure for supplying power thereto.

17. An exploitation structure according to claim 16, characterized in that the said column includes a flaring column or the like for burning part of the said gas.

18. An exploitation structure according to claim 1, characterized in that at least one of said well-heads is connected through a conduit line to a water injection unit supported by the said articulated column.

19. An exploitation structure according to claim 1, characterized in that at least one said well-head is connected through a conduit line to a gas reinjection unit supported by the said articulated column, the said gas proceeding from a production column of the said structure.

* * * * *